US005472082A

United States Patent [19]

Thiele

[11] Patent Number: 5,472,082

[45] Date of Patent: Dec. 5, 1995

[54] EXPANDABLE CLOSET HANGER

[76] Inventor: Glenn Thiele, 8560-D SW. 90th St., Ocala, Fla. 32676

[21] Appl. No.: 110,971

[22] Filed: Aug. 24, 1993

[51] Int. Cl.[6] ..... B65D 85/18

[52] U.S. Cl. ..... 206/284; 190/105; 190/22

[58] Field of Search ..... 206/283, 284; 190/103, 104, 105, 22, 21; 220/8

[56] References Cited

U.S. PATENT DOCUMENTS

| | | | |
|---|---|---|---|
| 1,184,525 | 5/1916 | Hammond | 190/104 |
| 2,180,489 | 11/1939 | Meyer | 223/85 |
| 2,205,118 | 6/1940 | Friedman | 190/104 |
| 2,335,243 | 11/1943 | Grieshaber | 28/102 |
| 2,475,961 | 7/1949 | Hilbert | 190/105 |
| 2,500,641 | 3/1950 | Mali et al. | 223/85 |
| 3,504,772 | 4/1970 | Barry | 190/105 |
| 3,692,171 | 9/1972 | Graham | 206/283 |
| 3,841,727 | 10/1974 | Peng | 190/21 X |
| 4,209,156 | 6/1980 | Kashden | 248/289 |
| 4,212,337 | 7/1980 | Kamp | 150/3 |
| 4,240,241 | 12/1980 | Sanborn, Jr. | 53/412 |
| 4,363,345 | 12/1982 | Scheibner | 150/3 |
| 4,786,190 | 11/1988 | Van Erden et al. | 381/61 |
| 4,787,488 | 11/1988 | Campanini | 190/22 X |
| 4,817,188 | 3/1989 | Van Erden | 383/63 |
| 4,829,641 | 5/1989 | Williams | 24/587 |
| 4,907,321 | 3/1990 | Williams | 24/587 |
| 4,925,316 | 5/1990 | Van Erden et al. | 383/61 |
| 4,995,516 | 2/1991 | Fine | 211/87 |
| 5,082,094 | 1/1992 | Nechushtan | 190/105 |
| 5,180,057 | 1/1993 | Franklin | 190/103 X |
| 5,314,046 | 5/1994 | Pedrini | 190/22 X |

*Primary Examiner*—Allan N. Shoap
*Assistant Examiner*—Christopher J. McDonald
*Attorney, Agent, or Firm*—Fisher, Christian & Sabol

[57] ABSTRACT

An expandable closet hanger which can be adjusted (expanded) in the directions of the three main directional axes.

5 Claims, 5 Drawing Sheets

EXPANDABLE CLOSET HANGER

BACKGROUND OF THE INVENTION

1. Field Of The Invention

The invention relates to an expandable receptacle hanger, more particularly expandable closet hangers.

2. Background Art

A pants hanger is disclosed in U.S. Pat. No. 2,335,243. The pants hanger includes a rigid, non-collapsible flat body, and an enlarged member which is adjustably mounted at the lower portion of the body and has an arcuate surface of substantial diameter. There are devices on opposite sides of the top of the flat body for attachment to separate portions of the pants. The devices on one side of the body have a pair of elongated strips adapted for insertion through the belt-loops of the pants, and flexible members which separately connect the strips to the body. The devices on the opposite side of the body have a clamp adapted for removable engagement with the cuff-ends of the pants, a yieldable element connected to the clamp and means for adjustably connecting the yieldable element to the upper portion of the flat body.

U.S. Pat. No. 2,500,641 discloses garment hangers which include a central support member, a hook element fixed to an end of the support member, and a plurality of similarly spaced cross members spaced uniformly from the hook element. Each of the cross members has its inner portion securely fixed to the support member at substantially spaced uniform intervals therealong to provide two substantially parallel rows of arms along the opposite sides of the support member. The spacing between the inner ends of the arms of each pair is equal to or substantially less than the spacing between adjacent cross members. The cross members are shaped so that each of the arms formed thereby extends from the support member in a substantially straight line and at substantially the same angle. The angle is such that the arms slope toward one end of the support member. There are elements at and integral with the ends of the arms. Each element is disposed at substantially the same angle so as to extend toward one end of the central support member. The latter angle is greater than the angle between the arms and the central support member.

U.S. Pat. No. 2,180,489 discloses a garment hanger and support therefor. There is a support, two parallel rails fixed thereto, and a hanger structure removably mounted on the rails. The hanger structure has a straight main portion .adapted to receive a garment thereover in folded conditions, and an inwardly directed bent portion extending from each end of the main portion. The bent portions terminate in free opposite spaced ends which are apart and are spaced from the main portion. The free ends of the bent portions are directed toward the main portion and approach each other to such extent as to provide a space therebetween to render freely accessible most of the main portion for unobstructed reception of the garment. The ends of the inwardly directed bent portions coact with the main portion to grip the garment therebetween.

See also U.S. Pat. Nos. 4,786,190 and 4,209,156.

Expandable brief cases are known. In one version, the brief case has a lid pivotally attached to the bottom portion. The height of the bottom portion can be varied by an accordion-like expansion element in each of the four vertical walls of the bottom portion.

Garment bags are known which have sides that are distortable thereby providing a limited expansion feature.

BROAD DESCRIPTION OF THE INVENTION

An objective of the invention is to provide expandable receptacle hangers, more particularly expandable closet hangers. Other objectives and advantages of the invention are set out herein or in the appended drawings or are obvious herefrom or in the appended drawings to one skilled in the art.

The objectives and advantages of the invention are achieved by the expandable receptacle hangers, more particularly the expandable closet hangers, of the invention.

The expandable closet hanger is readily adaptable, i.e., expandable, for storage of various sized clothing and other articles. It is lightweight but has strength. The expandable closet hanger can be used to transport clothing and other articles from location to location, while being hangable on a closet door. Preferably the body of the expandable closet hanger is detachable from the door hanger portion, so that the latter can be left mounted on the door. The expandable closet hanger can be hung on any door but is particularly useful when hung on the inside of a closet (to provide short-term or long-term storage). Of course, the expandable closet hangers can be hung on clothing rods in closets and the like, etc. The expandable closet hanger can, for example, be hung so as to be positioned on the inner or outer sides of closet doors, hung on other doors or even hung on or over hanger rods in closets. Shelves can be included within the closet hanger.

The expandable closet hanger can generally be used to hold blankets, various sizes of containers (e.g., baskets, small boxes, etc.), etc. The expandable closet hanger is adapted to receive articles of clothing and other articles in a manner which allows expansion in three dimensions so as to allow the enclosure of larger or more pieces of clothing or other articles. Suits, trousers, etc., can be hung in the expandable closet hanger in a smooth and neat manner. Shirts, sweaters, etc., can easily be stacked in the bottom of the expandable closet hanger. The expandable feature means that one can use the closet hanger with little or no wall distortion. The expandable closet hanger can have various basic sizes, e.g., it can be large enough for full length coats or dresses.

The body of the expandable closet hanger can be rigid or flexible, in part or all, although rigid walls are preferred. All or part of the coat hanger can be composed of a clear plastic material (provided it has enough structural strength). The body can be composed of, for example, plywood, cardboard, wood, plastic, cloth with metal wire structure, etc.

The container preferably uses reclosable closure means being operably responsive to digital pull-apart force applied to the wall segments of the container. The containers are expandable in two or three directions.

The expandable containers of the invention can be used for any removable room application, domestic or commercial (e.g., offices or apartments).

BRIEF DESCRIPTION OF THE INVENTION

DETAILED DESCRIPTION OF THE INVENTION

Figure 1:
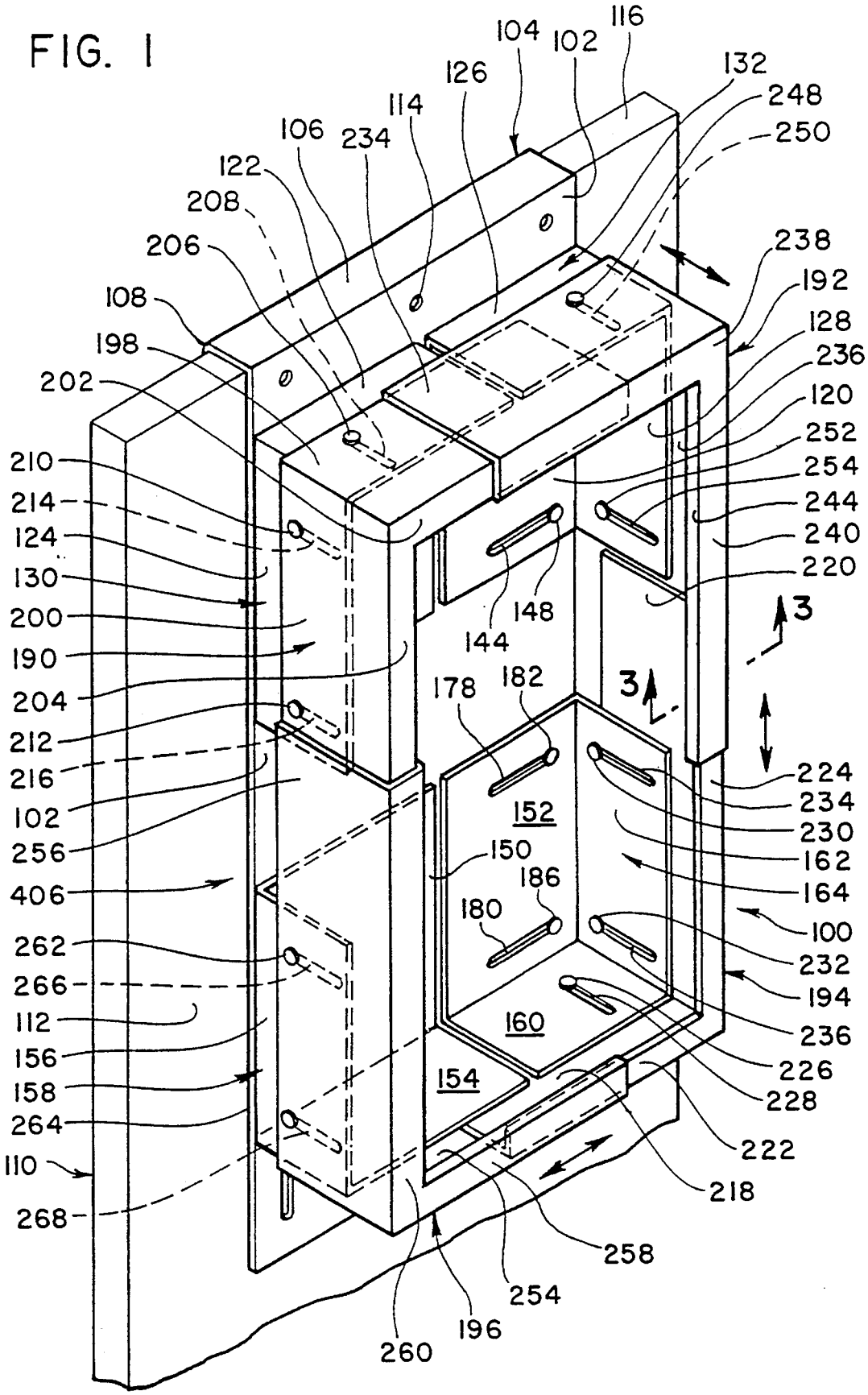
FIG. 1 is a perspective view of an embodiment of the expandable closet hanger of the invention.
Figure 2:
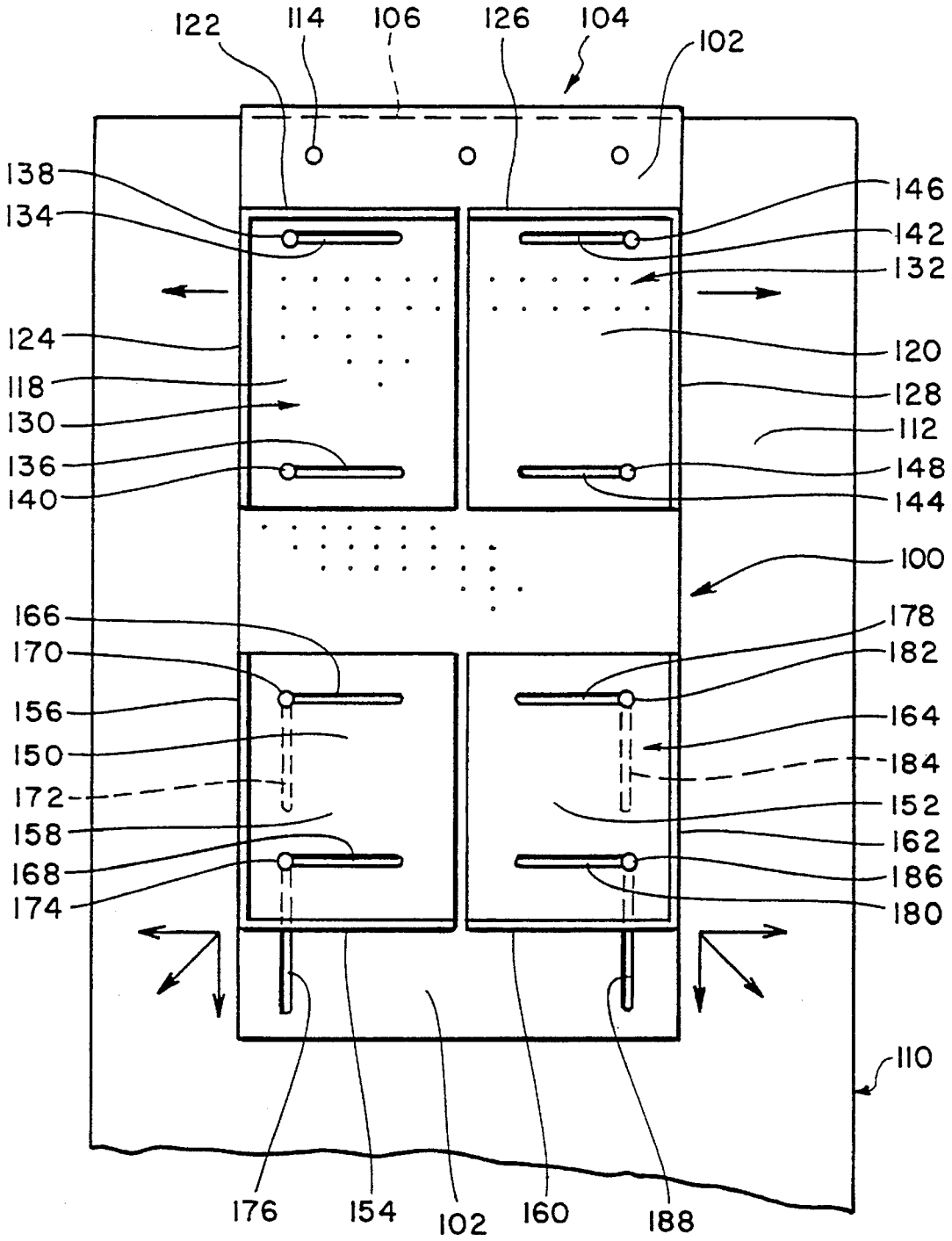
FIG. 2 is a front elevational view of the expandable closet hanger of FIG. 1 with front elements missing.
Figure 7:
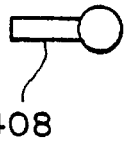
FIG. 7 is a view of pegs used in the hanging of the expandable closet hanger of FIG. 1.

A preferred embodiment of expandable closet hanger 100 is shown in FIGS. 1 and 2. Expandable closet hanger 100 has flat base 102 with top hanger portion 104. Top hanger portion 104 has top plate 106, which is oriented perpendicular to base 102, and lip 108, which is oriented perpendicular to top plate 106. As shown in FIG. 1, the top hanger portion is positioned on the top end (116) of door 110 whereby base 102 of expandable closet hanger 100 is positioned vertically on the inside surface (112) of door 110. Holes 114 in the top portion of base 102 allow expandable closet hanger 102 to be affixed to inside surface 112 of door 110 by means of screws, nails, bolts, etc. Also, pegs 406, as shown in FIG. 7, fit through holes 114 into holes (not shown) in door 110.

Flat base 118 is located in the upper left hand portion of base 102 and flat base 120 is located in the upper right hand portion of base 102. Base 118 has top wall 122 and left wall 124 —which comprises container element 130. Base 120 has top wall 126 and right wall 128—which comprises container element 132. Base 118 has upper slot 134 and lower slot 136. Numerals 138 and 140 represent pins which are mounted in base 118 and extend through slots 134 and 136, respectively. There is an enlarged head portion of pins 138 and 140 to keep container element 132 attached to base 102 while allowing movement of the first relative to the latter. Any suitable substitutes for pins 138 and 140 can be used, such as, screws or bolt-wing nut arrangements (as slots 134 and 136 are horizontally oriented, tension means such as bolt-wing nut arrangements are not necessary to keep container element 130 in the desired position). Container element 130 can be moved back and forth along slots 134 and 136 to provide the expandable feature in part. Base 120 has upper slot 142 and lower slot 144. Numerals 146 and 148 represent pins which are mounted in base 118 and extend through slots 142 and 144, respectively. There is an enlarged head portion of pins 146 and 148. Container element 132 can be moved back and forth along slots 142 and 144.

Flat base 150 is located in the lower left hand portion of base 102 and flat base 152 is located in the lower right hand portion of base 102. Base 150 has bottom wall 154 and left wall 156—which comprises container element 158. Base 152 has bottom wall 160 and right wall 162—which comprises container element 164. Base 150 has horizontal upper slot 166 and horizontal lower slot 168. Pin 170 fits through upper slot 166 and through vertical upper slot 172 in base 102. Pin 174 fits through lower slot 168 and through vertical lower slot 174 in base 102. There are enlarged head and tail portions of pins 170 and 174. Since the slot-sliding arrangement of container element 158 allows downwards movement (as well as outwards-inwards movement), it is preferable for at least one of pins 170 and 174 to be tension means so as to affix container element 158 in a desired position relative to base 102. The tension means suitably can be a bolt-wing nut. Base 152 has horizontal upper slot 178 and horizontal lower slot 180. Pin 182 fits through upper slot 178 and through vertical upper slot 184 in base 102. Pin 186 fits through lower slot 180 and through vertical lower slot 188 in base 102. There are enlarged head and tail portions of pins 182 and 186. Since the slot-sliding arrangement of container element .164 allows downwards movement (as well as outwards-inwards movement), it is preferable for at least one of pins 182 and 186 to be tension means so as to affix container element 164 in a desired position relative to base 102. The tension means suitably can be a bolt-wing nut.

Referring to FIG. 1, an arrangement is shown for an expandable feature of container 100 in perpendicular relationship to base 102. The invention includes one dimensional, two dimensional and three dimensional expansion capabilities. L-shaped container elements 190, 192,194 and 196 form a lid which fit a base box formed by container elements 130, 132, 158 and 164. L-shaped container element 190 has top wall 198, left wall 200, flat top rim 202 (atop of top wall 198) and flat side rim 204 (atop of left wall 200). Top wall 198 has pin 206 which fits through slot 208 which is located in top wall 122 of container element 130 and is perpendicular to base 102. Side wall 200 has top pin 210 and bottom pin 212 which fit through slot 214 and slot 216, respectively, which are located in side wall 124 of container element 130 and are perpendicular to base 102. There are enlarged head and tail portions of pins 206, 210 and 212. Any suitable substitutes for pins 206, 210 and 212 can be used, such as, bolt-wing nut arrangements (although tension means are not necessary but are sometimes convenient). L-shaped container element 194 has bottom wall 218, right wall 220, flat bottom rim 222 (atop of bottom wall 218) and flat side rim 224 (atop of right wall 220). Top wall 218 has pin 226 which fits through slot 228 which is located in bottom wall 160 of container element 164 and is perpendicular to base 102. Side wall 220 has top pin 230 and bottom pin 232 which fit through slot 234 and slot 236, respectively, which are located in side wall 162 of container element 164 and are perpendicular to base 102. There are enlarged head and tail portions of pins 226, 230 and 232. Any suitable substitutes for pins 226, 230 and 232 can be used, such as, bolt-wing nut arrangements (although tension means are not necessary but are sometimes convenient).

Figure 3:
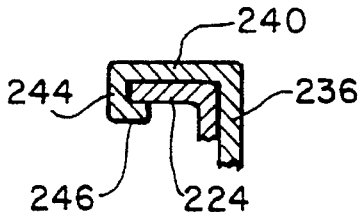
FIG. 3 is a cross-sectional view of the top regions (rims) of two of the top rims of the expandable closet hanger of FIG. 1.

L-shaped container element 192 has top wall 234, right wall 236, flat top rim 238 (atop of top wall 234) and flat side rim 240 (atop of right wall 236). Right wall 220 and flat side rim 224 of container element 194 extend above right wall 162 of container element 164. Right wall 236 and side rim 224 extend below right wall 128 of container element 132. Right wall 236 of container element 192 extends further out from base 102 than does right wall 162 so that the upper end of side rim 224 (slidably) lies under side rim 240. Similar to that shown in FIG. 3, side arm 242 is positioned inside of side rim 224 and bottom arm 244 is positioned below wide rim 224. This arrangement causes containers 164 and 192 to move in unison in the perpendicular direction to base 102. Top wall 234 and top rim 238 extend beyond top wall 126 of container element 132. Top wall 198 and top rim 202 extend beyond top wall 122 of container element 130. Top wall 234 of container element 192 extends further out from base 102 than does top wall 198 of container element 190 so that the upper end of top rim 202 (slidably) lies under top rim 238. There are inside and bottom arms (not shown) so that top rim 202 is partially ringed in a manner as shown in FIG. 3. Top wall 234 has pin 248 which fits through slot 250 which is located in top wall 126 of container element 132 and is perpendicular to base 102. Side wall 236 has top pin (not shown) and bottom pin 252 which fit through a top slot (not shown) and bottom slot 254, respectively, which are located in side wall 128 of container element 132 and are perpendicular to base 102. There are enlarged head and tail portions of pins 248 and 252 and the top pin. Any suitable substitutes for pins 248 and 252 and the top pin can be used, such as, bolt-wing nut arrangements (although tension means are not necessary but are sometimes convenient).

L-shaped container element 196 has bottom wall 254, left wall 256, flat bottom rim 258 (atop of bottom wall 254) and flat side rim 260 (atop of left wall 256). Left wall 256 and flat side rim 260 of container element 196 extend above right wall 124 of container element 190. Bottom rim 258 extends beyond bottom wall 218 and bottom rim 222 of container element 164. Left wall 256 of container element 196 extends further out from base 102 than does right wall 200 so that the upper end of side rim 204 (slidably) lies under side rim 260. Similar to that shown in FIG. 3, a side arm is positioned inside of side rim 204 and a bottom arm is positioned below wide rim 204. This arrangement causes containers 190 and 196 to move in unison in the perpendicular direction to base 102. Top wall 254 and top rim 258 extend beyond top wall 154 of container element 158. Top wall 218 and top rim 222 extend beyond top wall 154 of container element 158. Top wall 258 of container element 196 extends further out from base 102 than does top wall 218 of container element 194 so that the upper end of top rim 222 (slidably) lies under top rim 258. There are inside and bottom arms (not shown) so that top rim 222 is partially ringed in a manner as shown in FIG. 3. Bottom wall 254 has a pin (not shown) which fits through a slot (not shown) which is located in bottom wall 154 of container element 158 and is perpendicular to base 102. Side wall has top pin 262 and bottom pin 264 which fit through slot 266 and slot 268, respectively, which are located in side wall 156 of container element 158 and are perpendicular to base 102. There are enlarged head and tail portions of pins 262 and 264 and the other pin. Any suitable substitutes for pins 262 and 264 and the other pin can be used, such as, bolt-wing nut arrangements (although tension means are not necessary but are sometimes convenient).

By loosening the tension on the clamping elements, where used, container elements can be moved in relation to each other so as to adjust the size of expandable closet hanger 100. The size of expandable closet hanger 100 can be expanded in two or three dimensions, reduced in two or three dimensions, or expanded or reduced in two or three dimensions while being reduced or expanded, respectively, in the other dimension, etc..

The front of expandable closet hanger 100 is open. The opening can be partially or fully closed with any suitable covering or door, keeping in mind the expandable feature of device 100.

Figure 4:
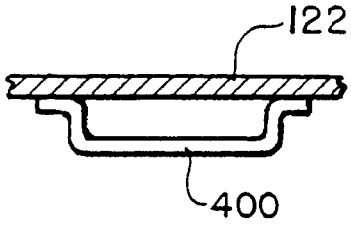
FIG. 4 is a view of a hanger in the expandable closet hanger of FIG. 1.

As shown in FIG. 4, hanger 400 can be located, for example, on the bottom of top wall 122 of container 130.

Figure 5:
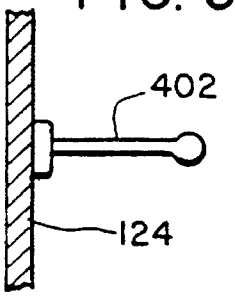
FIG. 5 is a view of another hanger in the expandable closet hanger of FIG. 1.

As shown in FIG. 5, hanger 402 can be mounted, for example, on side wall 124 of container element 130. The hanger structure of U.S. Pat. No. 4,995,516 can be used as hanger 402. The pertinent portions of U.S. Pat. No. 4,995,516 are incorporated herein by reference.

Figure 6:
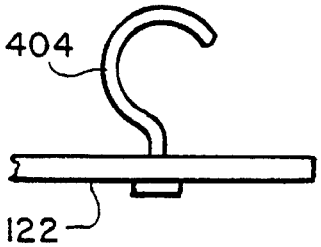
FIG. 6 is a view of an alternative means of hanging the expandable closet hanger of FIG. 1.

As shown in FIG. 6, if top hanger portion 104 is not used, conventional supporting hook 404 can be mounted, for example, in top wall 122 of container element 130. It is best to also use a further conventional supporting hook in top wall 126 of container element 132.

Figure 8:
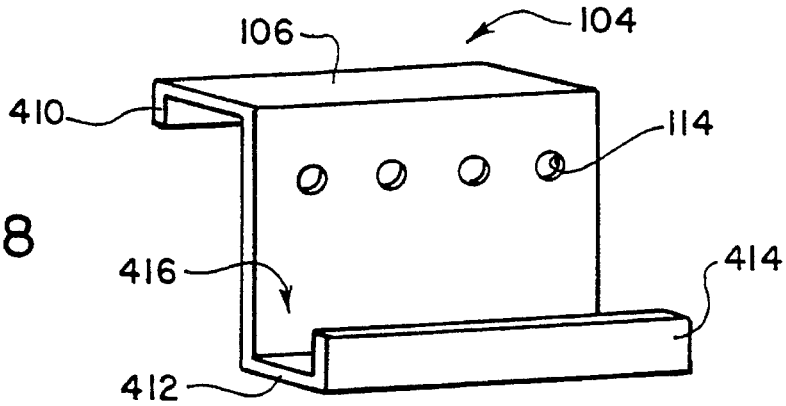
FIG. 8 is a perspective view of an embodiment of the hanger portion of the expandable closet hanger of FIG. 1.
Figure 9:
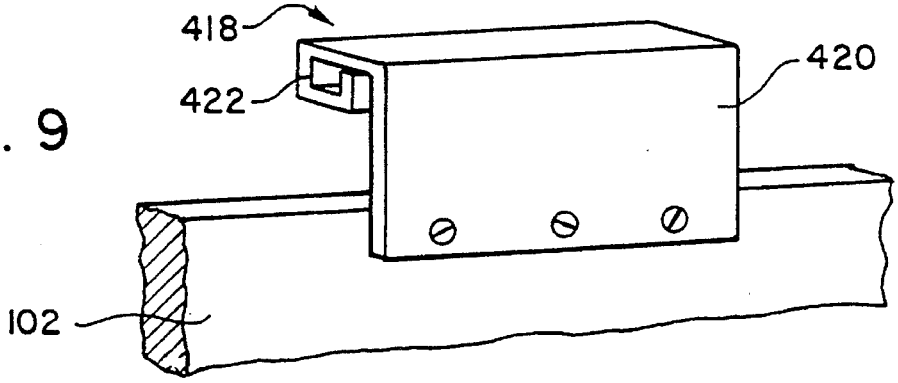
FIG. 9 is a perspective view of another embodiment of the hanger portion of the expandable closet hanger of FIG. 1.

FIG. 8 discloses an embodiment of hanger portion 104 of expandable closet hanger 100 wherein container portion 406 of expandable closet hanger 100 is separable from hanger portion 104. In this embodiment, bottom groove (416) is formed by horizontal arm 412 and vertical rim 414. Female hanger 418 has vertical plate 420 and cantilevered female bar 422. Female bar 422 removably fits in groove 416. Vertical plate 420 is affixed to the top of base 102.

Figure 10:
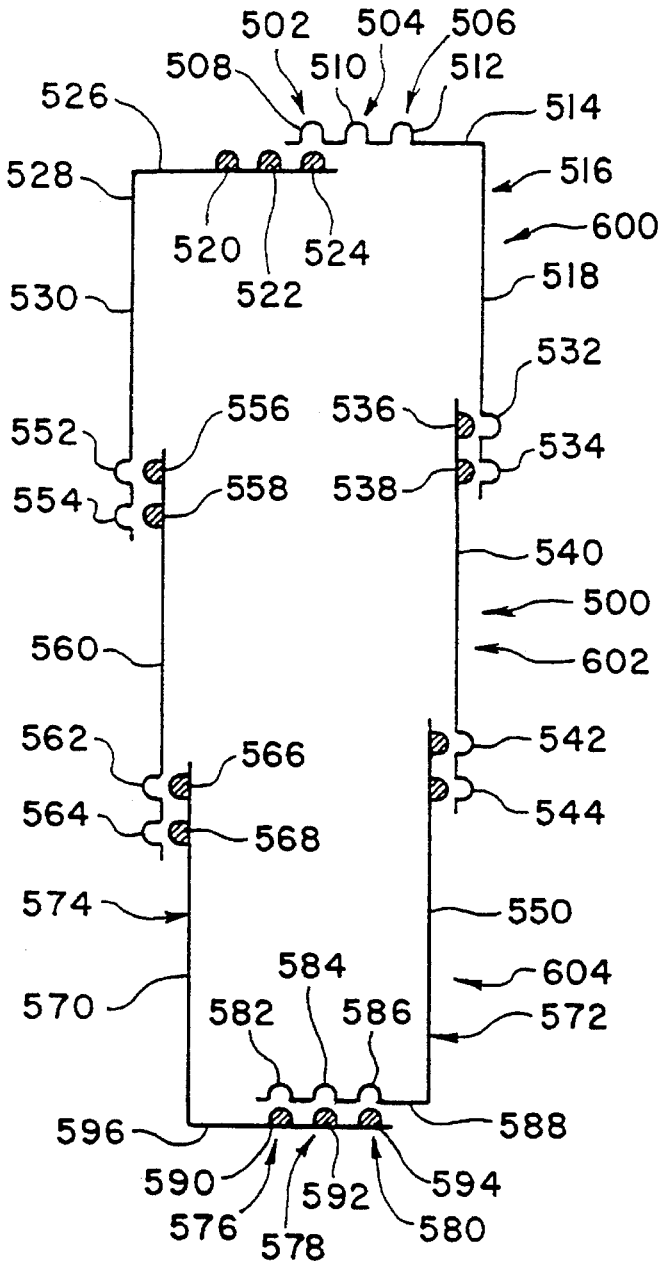
FIG. 10 is a right side elevational view of another embodiment of the expandable closet hanger of the invention.
Figure 11:
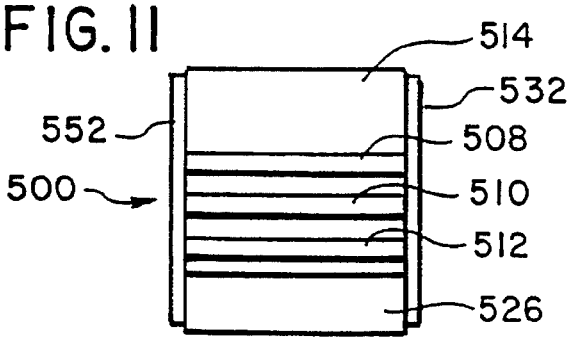
FIG. 11 is a top elevational view of the expandable closet hanger of FIG. 10.
Figure 12:
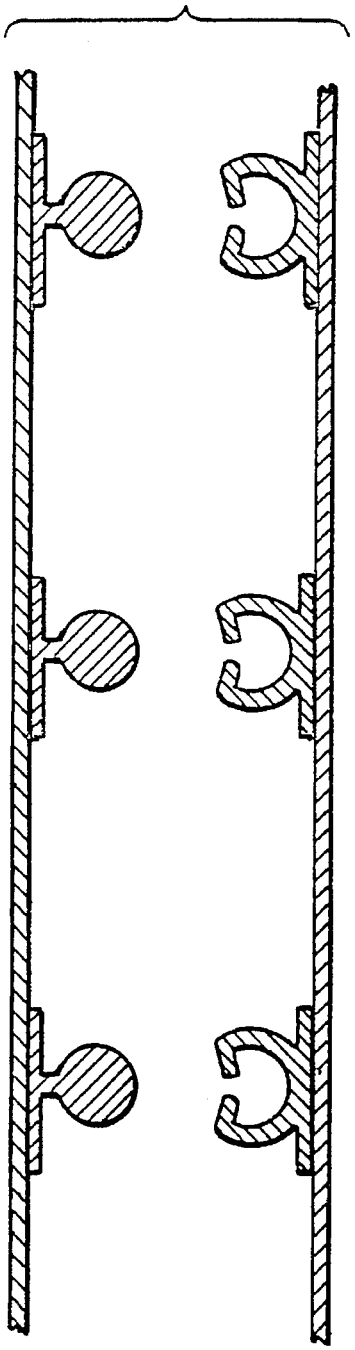
FIG. 12 is a partial view of specific closure elements of the expandable closet hanger of FIG. 10.

FIGS. 10 to 12 illustrate a preferred embodiment of the expandable closet hanger 500, which is box shaped. Receptacle 500 has top section 600, mid section 602 and bottom section 604. As shown in FIG. 10, receptacle 500 has a rectangular vertical cross-section. As shown in FIG. 11, receptacle 500 has a rectangular horizontal cross-section. If desired, more than one middle section 602 can be used or middle section can be left out, whereby expansion or contraction can be achieved in the vertical section.

Receptacle 500 is expandable or adjustable in the horizontal direction by means of fastener strips 502, 504 and 506 (more or less can be used). Female grooves 508, 510 and 512 are part of or mounted on top wall 514 of container segment 516 (which also has front wall 518). Female grooves 508, 510 and 512 fit on male rib elements 520, 522 and 524, respectively, which are mounted on top wall 526 of container segment 528 (which also contains side wall 530). Hanger means (not shown) can be attached to top wall 526 or side wall 530 of container segment 528. Horizontal expansion can be done, for example, by placing female grooves 508 and 510 on male rib elements 522 and 524, respectively, in a pressure fitting manner.

The bottom region of front wall 518 has female grooves 532 and 534, which fit (pressure) on male rib elements 536 and 538, respectively, located in the top region of side wall of front wall 540 of middle section 602. The bottom region of front wall 540 has female grooves 542 and 544, which fit (pressure) on male rib elements 546 and 548, respectively, located in the top region of front wall 550 of container segment 572. The bottom region of back wall 530 has female grooves 552 and 554, which fit (pressure) on male rib elements 556 and 558, respectively, in the top region of back wall 560 of middle section 602. The bottom region of backwall 560 has female grooves 562 and 564, which fit (pressure) on male rib elements 566 and 568, respectively, in the top region of back wall 570 of container segment 574.

The expansion or adjustment of receptacle 500 in the horizontal direction is also achieved by means of fastener strips 576, 578 and 580 (more or less can be used). Female grooves 582, 584 and 586 are part of or mounted on bottom wall 588 of container segment 572. Female grooves 582, 584 and 586 fit on male rib elements 590, 592 and 594, respectively, which are mounted on bottom wall 596 of container segment 574. Horizontal expansion can be done, for example, by placing female grooves 582 and 584 on male rib elements 592 and 594, respectively, in a pressure fitting manner. (The first channel element is pressed into the second channel element.)

This embodiment illustrates how the container can be expanded by adding sub-units at the bottom of the container (the same can be done to the sides, i.e., in any direction). Pressure, interlocking strips of the type shown herein are preferable to velcro-type interlocking arrangements because the latter are too hard to use and provide relatively weak bonding.

Referring to FIG. 12, walls 900 and 902 are shown overlapping. On the surface of wall 900 facing wall 902 is a series of three fastener strips 904 (a, b and c), (by means of base 908). On the surface of wall 902 which faces wall 900 is a series of three fastener strips 906 (a, b and c) (by means of base 910) which are aligned with fastener strips 904. Fastener strips 904 and 906 are attached to walls 900 and 906, respectively, by any suitable means such as glue, other adhesive material, stitching, rivets, heat welding (e.g., plastic to plastic), etc. Each fastener strip 904 is a female groove profile element. Each fastener strip 906 is a male rib profile element. In other words, fastener strips 904 and 906 are formed with pressure reclosable (continuous) rib and groove profiles along the facing surfaces of walls 900 and 902 to provide reopenable and reclosable attachment between walls 900 and 902. Coaction between walls 900 and 902 and fastener elements 904 and 906 is attained so that weight in expandable closet hanger 100 and that stresses and pulls on walls 900 and 902 do not easily pull apart fastener elements 904 and 906. Two or more of the fastener strips 904 or 906 can be formed on the same base.

Any conventional or suitable reclosable zipper type closures (closure fastening devices) can be used as the closure fastening device. The closure fastening devices are usually made of plastic material. The reclosable zipper type closures, for example, can constitute the groove profile fastener strip 18 and the rib profile strip **17*a*** of U.S. Pat. No. 4,817,188. The pertinent portions of U.S. Pat. No. 4,817,188 are incorporated herein by reference. The reclosable zipper type closure can also be those disclosed by U.S. Pat. No. 4,925,316 (complementary plastic profiled fastener strips—each of which is composed of two or more generally arrow-shaped releasably interlockable complementary profiles), U.S. Pat. No. 4,240,241, U.S. Pat. No. 4,212,337, U.S. Pat. No. 4,363,345, U.S. Pat. No. 4,829,641 and U.S. Pat. No. 4,907,321; the pertinent portions of these U.S. patents being incorporated herein by reference.

The closure fastening devices of the prior art generally have readily flexible walls which are distortable to a substantial degree on which the fastener strips are mounted. This is not the case with the invention container which uses walls (at least where the closure fastening devices are affixed) which preferably are non-distortable and flexible. Also, with the expandable feature of the invention container, there is no need to use flexible walls.

Figure 13:
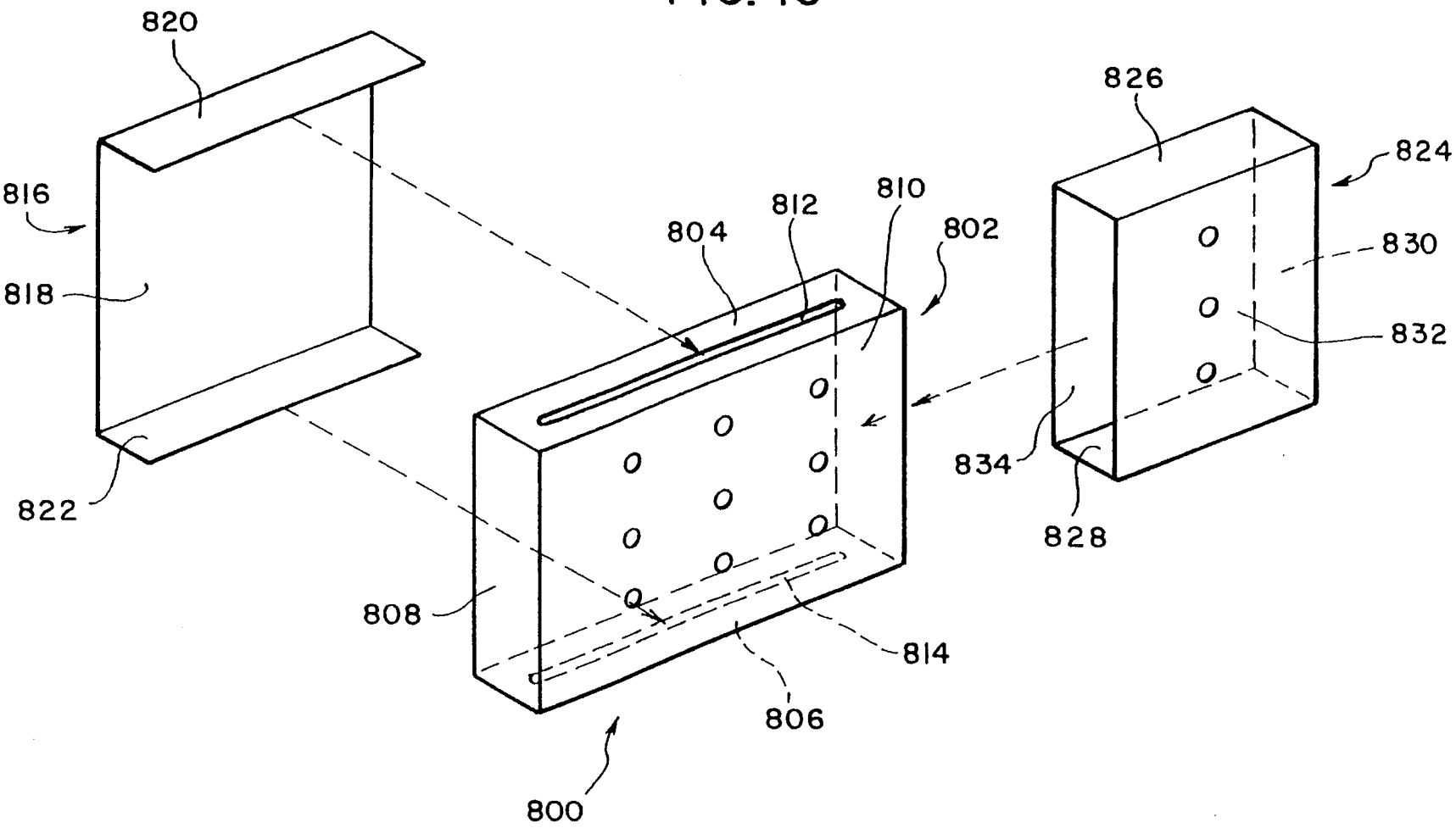
FIG. 13 is a perspective view, in exploded form, of another embodiment of the expandable closet hanger of the invention.

FIG. 13 illustrates a preferred embodiment of the expandable closet hanger (800) which is expandable in two directions. Receptacle base 802 is box shaped, having top 804, bottom 806 left side 808 and front 812. The back side of receptacle base 802 is open. The right side of receptacle base 802 is also open. Elongated slot 812 is located in top 804. Elongated slot 814 is located in bottom 806. Receptacle back 816 has back 818, top lip 820 and bottom lip 822. The length of top lip 820 is small enough to allow it to be slipped into slot 812; the length of bottom lip 822 is small enough to allow it to be slipped into slot 806. By moving receptacle back 816 in relation to receptacle base 802, expansion in one horizontal direction is achieved. Receptacle side container 824 has top 826, bottom 828, right side 830, front 832 and back 834. The left side of receptacle side container 824 is open. The vertical cross-sectional dimensions of receptacle side container 824 are such that it can be slid into open right side 810 of receptacle base 802 (even when assembled with receptacle back 816). By moving receptacle side container 824 in relation to receptacle base 802, the box is expandable in the perpendicular horizontal direction. Hanger means, such as, hanger 404 in FIG. 6, can be attached to top 804 of receptacle base 802. Articles of clothing etc., can be placed in expandable hanger 800.

What is claimed is:

1. An expandable closet hanger, comprising:

(a) a rigid non-collapsible flat body having a first end portion and a second end portion;

(b) means for suspending the closet hanger, which is affixed to said first end portion of said flat body; and (c) an expandable receptacle body affixed to said flat body, wherein said expandable receptacle body contains at least two telescoping portions, at least one of said telescoping portions being movable along an axis which is perpendicular to an axis along which another of said telescoping portions is movable, both of said axes being parallel to said flat body, whereby said expandable receptacle body can be expanded in at least one direction but no more than two directions, along each of said axes, which is parallel to said flat body.

2. The expandable closet hanger of claim 1 whereby said expandable receptacle body contains another telescoping portion which is movable along an axis which is perpendicular to said flat body whereby said expandable receptacle body is expandable along said axis which is perpendicular to said flat body, away from said flat body.

3. An expandable closet hanger, comprising:

(a) a rigid non-collapsible flat body having a first end portion and a second end portion;

(b) means for suspending the closet hanger, which is affixed to said first end portion of said flat body; and (c) an expandable receptacle body affixed to said flat body, whereby said expandable receptacle body contains at least two telescoping portions, the first of which allows said expandable receptacle body to be expanded in at least one direction but no more than two directions, along an axis which is parallel to said flat body, and the second of which is movable along an axis which is perpendicular to said flat body whereby said expandable receptacle body is expandable along said axis, which is perpendicular to said flat body, away from said flat body.

4. An expandable closet hanger comprising:

a rigid non-collapsible flat body having a first end portion and a second end portion;

means for suspending the closet hanger, which is affixed to the first end portion of the flat body; and an expandable receptacle body movably affixed to said flat body, said expandable receptacle body having four inner units which are each mounted on said flat body next to two of the other inner units and opposite of the other inner unit, each of said inner units being movably mounted on said flat body so as to be movable along a first axis and along a second axis, said first axis and said second axis being perpendicular to each other and being parallel to said flat body, and said expandable receptacle body having four outer units, each said outer units being telescopingly mounted in relation to one of said inner units so as to be movable along a third axis which is perpendicular to said flat body, and said outer units being mounted in telescopingly arrangmenets so as to each be movable along said first axis and along said second axis in conjunction with movement of the corresponding inner unit along the said first axis and said second axis.

5. The expandable closet hanger of claim 4 wherein the inner and outer units are movable by means of a series of slots and pins in the inner and outer units and the flat body.

* * * * *